US005958538A

United States Patent [19]

Kessler

[11] Patent Number: 5,958,538

[45] Date of Patent: Sep. 28, 1999

[54] FLOOR MAT SYSTEM

[75] Inventor: Ronald N. Kessler, Girard, Ohio

[73] Assignee: R & L Marketing Sales, Inc., Boardman, Ohio

[21] Appl. No.: 08/822,730

[22] Filed: Mar. 24, 1997

[51] Int. Cl.[6] ..... B32B 3/14; B32B 3/08

[52] U.S. Cl. ..... 428/45; 52/177; 52/384; 15/215

[58] Field of Search ..... 428/45; 52/177, 52/387, 384; 15/215, 216

[56] References Cited

U.S. PATENT DOCUMENTS

| | | | |
|---|---|---|---|
| 4,143,194 | 3/1979 | Wihksne | 428/45 |
| 4,361,614 | 11/1982 | Moffitt | 52/177 |
| 4,468,910 | 9/1984 | Morrison | 428/45 |
| 4,796,399 | 1/1989 | Kessler et al. | 52/177 |
| 4,963,054 | 10/1990 | Hayashi | 52/387 |

*Primary Examiner*—Alexander Thomas
*Attorney, Agent, or Firm*—Sand & Sebolt

[57] ABSTRACT

A floor mat system having a plurality of floor mats and a frame assembly. The floor mats are formed by a series of parallel spaced first ribs intregally formed with a series of parallel spaced second ribs forming rectangular openings therebetween. Certain of the second ribs include an enlarged bottom end which support the floor mat above the floor and form a drainage area beneath the floor mats. A frame assembly includes inner and outer frame members which extend between and around the floor mats, respectively. Each of the inner and outer frame members is formed with a seal receiving recess for optionally and selectively receiving a seal. The seals may be selectively inserted within the recesses to direct and disperse water beneath the floor mats. The floor mats are easily removed from within the frame assembly by lifting the floor mats from within the wells allowing the water and debris to be cleaned therefrom. A drain may be formed beneath one of the floor mats and the seals may be selectively inserted within the frame members to direct the water and debris toward the drain. The outer frame members have a ramped top surface to provide as smooth transition between the floor and the floor mat system. The frame assembly and floor mats are substantially the same height providing a substantially flat upper surface of the floor mat system.

11 Claims, 4 Drawing Sheets

FLOOR MAT SYSTEM

BACKGROUND OF THE INVENTION

1. Technical Field

Generally, the invention relates to a floor mat system. Particularly, the invention relates to a floor mat system which includes a frame mounted on the floor and floor mat positioned within the frame. Specifically, the invention relates to a floor mat system which includes outer frame members having a ramped top surface and defining a periphery of an area to be covered by the floor mat system and inner frame members which divide the area into wells which receive the floor mats, whereby the inner and outer frame members are formed with a seal receiving recess which receives a seal for selectively preventing water from flowing under certain of the frame members.

2. Background Information

Floor mats are often used at the entrances of businesses for customers to wipe water and snow from the bottoms of their shoes. Conventional floor mats are constructed of a flexible rubber and are formed with a plurality of spaced apart orthogonal ribs which form rectangular-shaped openings. These conventional floor mats require that a recessed area be formed in the floor where the floor mats are located with the edges of the recessed area preventing the floor mats from sliding when walked upon by a customer. The water and snow from the customer's shoes flows through the openings keeping the top surface of the floor mat free of standing water.

Although these prior art floor mats are adequate for the purpose for which they were intended, the business owner must plan for the installation of these floor mats and have the recessed area built into the floor during construction of the building. If these prior art floor mats are merely placed on the floor without a recessed area the floor mats slide when a horizontal pressure from a customers shoes or from strong wind is applied on the mats. Alternatively, the recessed area can be dug out of the floor after the building has been constructed at a great expense to the business owner. Additionally, even when a recessed area has been provided to accept the floor mat, if large mats are utilized, or a number of mats are utilized adjacent one another, the mats may still move within the recessed area possibly causing an unsafe condition.

Another type of floor mat merely sits on the floor allowing the water and snow from the customers' shoes to flow through the openings. Unless these floor mats are surrounded by some type of frame, the water will eventually build up beneath the floor mat and flow back out into the traffic area creating a puddle of water in front of the floor mat where the customers step. If the floor mat is placed within the business owner's store, the water will eventually flow out into the aisles or walkways creating a slippery and hazardous condition.

Also, if the area to be covered by the floor mats is a relatively large area such as the entrance or exit to a supermarket, a plurality of these floor mats must be placed at the entrance way to collect the snow and water from customer's shoes. If each of these plurality of floor mats is contained within its own separate frame, the front floor mats which the customers walk upon first will collect a majority of snow and water while the floor mats closer to the door will be relatively dry. Eventually, the front floor mats will fill with water causing an overflow of water into the walkway or causing standing water on the top surface of the mat.

Therefore, the need exists for an improved floor mat system having inner and outer frame members which extend between and around, respectively, a plurality of floor mats, which frame members attach directly to the floor to restrict movement of the floor mats, in which the frame members include a seal receiving recess formed in a bottom end thereof for selectively receiving a seal and which the mats are easily removable from within the frame to allow the water under the mat to be cleaned up and which are easily placed back in the frame.

SUMMARY OF THE INVENTION

Objectives of the invention include providing a floor mat system which is easily installed to any floor without substantial modification to the floor.

Another objective is to provide a floor mat system in which the floor mat is constructed of a flexible durable material which will withstand inclement weather.

A further objective is to provide a system which includes a frame attached to the floor which forms a well for receiving the floor mat and restricting movement of the floor mat.

A further objective is to provide a system in which the floor mat can be easily removed from the frame to allow clean-up of any dirt, debris or water under the mat and which can easily be placed back within the frame after clean-up.

Still another objective is to provide a system in which the frame members can be easily installed into existing recessed areas to replace old mat systems.

Another object is to provide a system which allows water to be evenly directed and dispersed under the floor mats.

A further objective is to provide such a system which may be sealed under certain sections of the frame to selectively prevent or contain the flow of water thereunder.

A still further objective of the invention is to provide such a floor mat system which is of simple construction, which achieves the stated objectives in a simple, effective and inexpensive manner and which solves problems and satisfies needs existing in the art.

These objectives and advantages are obtained by the improved floor mat system of the present invention, the general nature of which may be stated as including a floor mat system adapted to lay on a floor, said system including: a mat adapted to lay on the floor; a frame assembly adapted to lay on the floor and positioned adjacent to the mat; and a seal receiving recess formed in the frame assembly.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
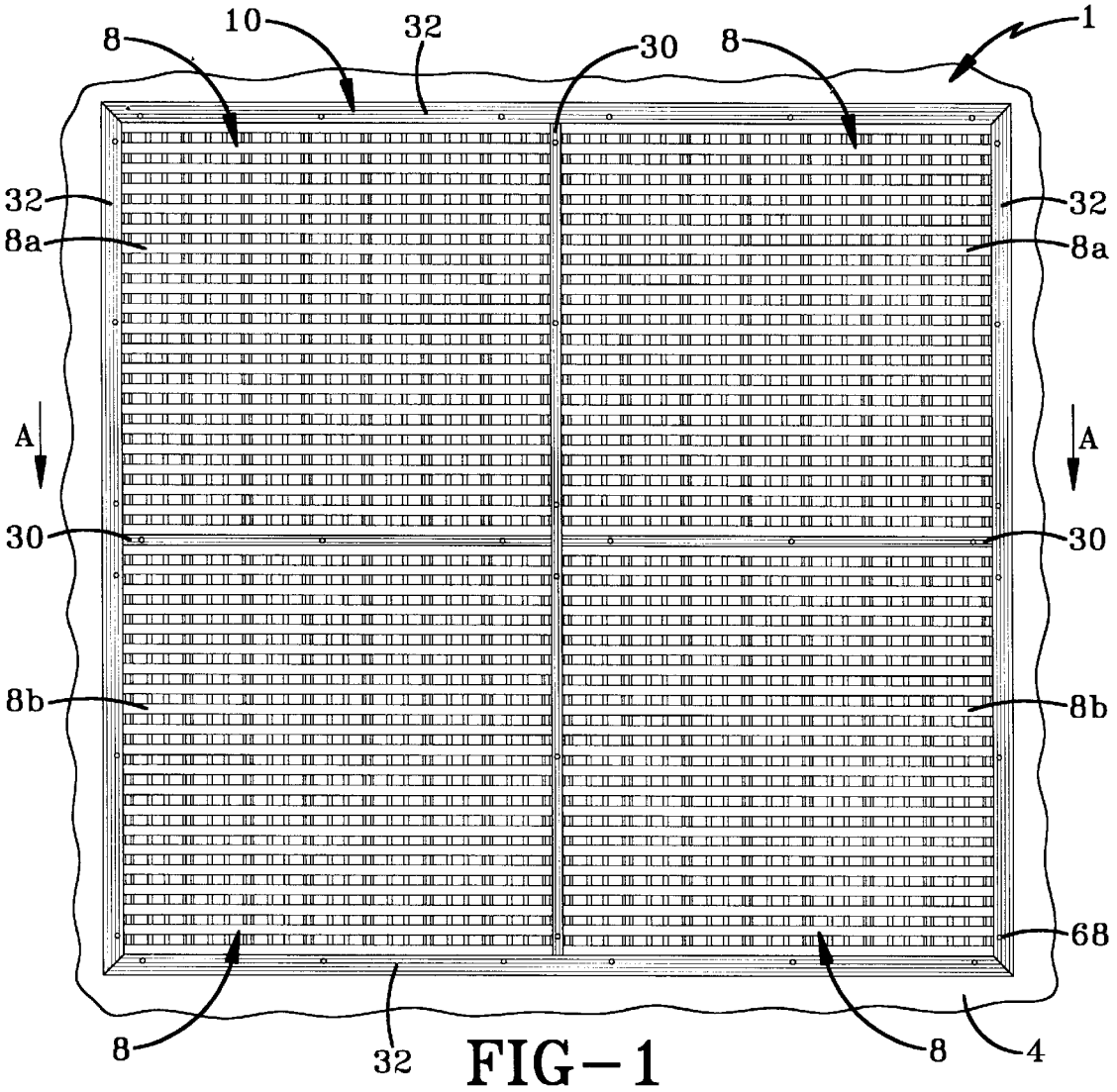
FIG. 1 is a top plan view of the floor mat system of the present invention.

The floor mat system of the present invention is shown in FIG. 1 and is indicated generally at 1. System 1 is shown in FIGS. 1–4 positioned directly on a floor 4. However, system 1 can be positioned within a recessed area which is formed in floor 4 without departing from the spirit of the present invention. Floor 4 may be constructed of various materials, such as wood or blacktop, and is shown in FIGS. 1–4 constructed of cement.

System 1 includes a plurality of floor mats, indicated generally at 8, and a frame assembly, indicated generally at 10 (FIG. 2), which extends around and between floor mats 8. In the preferred embodiment, floor mats 8 are 4 foot by 4 foot but may be various sizes without affecting the concept of the invention. Floor mats 8 include a series of first parallel rectangular-shaped ribs 14 (FIG. 4) which are spaced apart from one another by a distance substantially equal to their width, or approximately ¼ inches. A series of second spaced parallel rectangular-shaped ribs 17 extend perpendicular to and between first ribs 14 forming rectangular openings 20 therebetween.

In accordance with one of the features of the invention, second ribs 17 consist of a pair of middle ribs 18 which extend between a pair of support ribs 18*a*. Middle ribs 18 are approximately ⅛ inches wide and are separated from one another by a distance which is approximately 5⁄16 inches. Support ribs 18*a* have an enlarged bottom 21 which forms an upwardly facing shoulder 24 on each side of support ribs 18*a*. Support ribs 18*a* are spaced apart from adjacent middle ribs 18 by a distance of approximately ⅜ inches. Additionally, second ribs 17 are slightly shorter than first ribs 14 thereby creating a sculptured top surface of floor mat 8. Additionally, enlarged bottom 21 extends substantially below the bottom surface of first ribs 14 and of middle ribs 18 thereby suspending the majority of floor mat 8 above floor 4 thereby creating drainage channels 26 for water and debris scrape from customer's shoes.

Frame assembly 10 includes inner frame members 30 and outer frame members 32 which extend between and around, respectively, floor mats 8 as described below. Inner frame members 30 are elongated rectangular shaped members formed with a generally U-shaped seal receiving recess 36 in the bottom thereof. Inner frame members 30 include a top surface 38 which is formed with a pair of spaced parallel raised projections 40 extending the entire length of inner frame members 30 and a pair of opposed sidewalls 42 having a bottom end 44 positioned on each side of recess 36.

Outer frame members 32 are elongated and generally triangular shaped in cross-section. Outer frame members 32 have an inner sidewall 48, and angled top surface 50 which is tapered downwardly away from sidewall 48 and which includes a plurality of raised projections 52 formed along the entire length thereof, and a bottom end 54. Bottom end 54 is formed with a seal receiving recess 58 which includes a generally U-shaped section 60 formed adjacent sidewall 48, a generally triangular shaped section 62 formed at an angle similar to that of top surface 50 and a middle gap 64 which extends between and connects sections 60 and 62. Inner and outer frame members 30 and 32, respectively, are secured to floor 4 by a plurality of screws 68 which extend through the frame members and into floor 4.

In accordance with one of the main features of the invention, inner and outer frame members 30 and 32, respectively, may optionally and selectively receive a seal 70 and 72, respectively. Seal 70 is a generally tubular shaped member having a center hole 74 and is formed of a resilient material such as rubber. Seal 70 may be positioned within U-shaped seal receiving recess 36 and is sandwiched between inner frame member 30 and floor 4. The downward pressure of inner frame member 30 causes seal 70 to deform to the oval shape shown in FIG. 4 creating a watertight seal between inner frame member 30 and floor 4.

Seal 72 of outer frame member 32 is a generally flat piece of resilient material such as rubber, having first and second sides 76 and 78 and a flat intermediate section 80 extending between sides 76 and 78. Side 76 extends within U-shaped section 60 of seal receiving recess 58, flat intermediate section 80 is sandwiched within gap 64 of seal receiving recess 58 and side 76 extends within triangular shaped section 62 of seal receiving recess 58. Seal 72 is sandwiched between outer frame member 32 and floor 4 creating a watertight seal between outer frame member 32 and floor 4.

Figure 3:
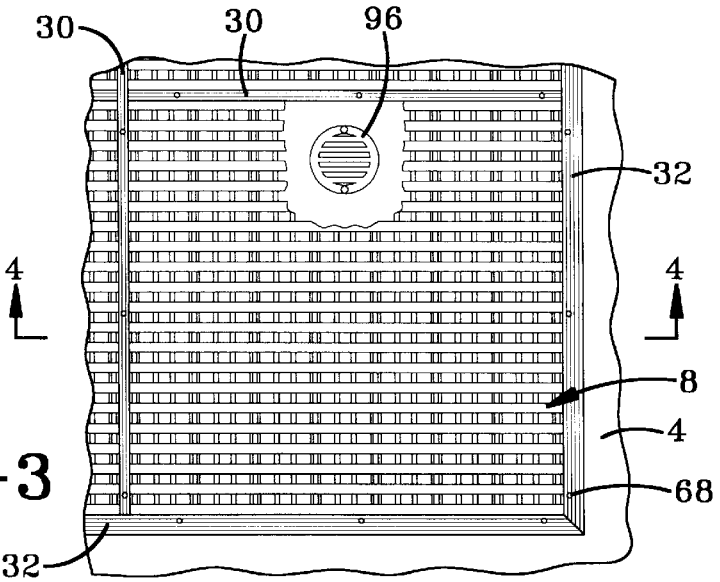
FIG. 3 is a fragmentary top plan view of the floor mat system of FIG. 1 with portion broken away.
Figure 2:
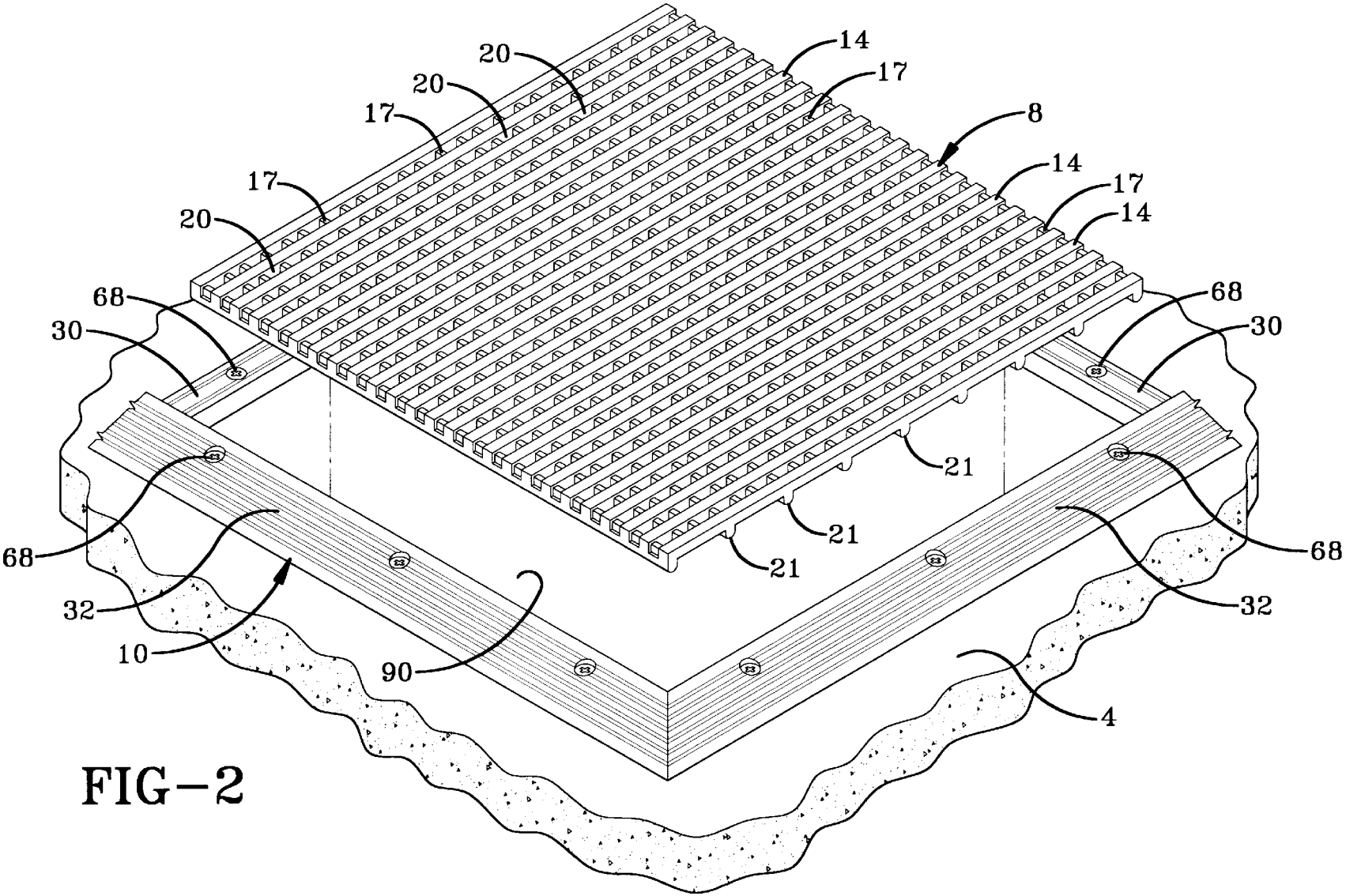
FIG. 2 is an exploded perspective view of the floor mat system of FIG. 1.
Figure 4:
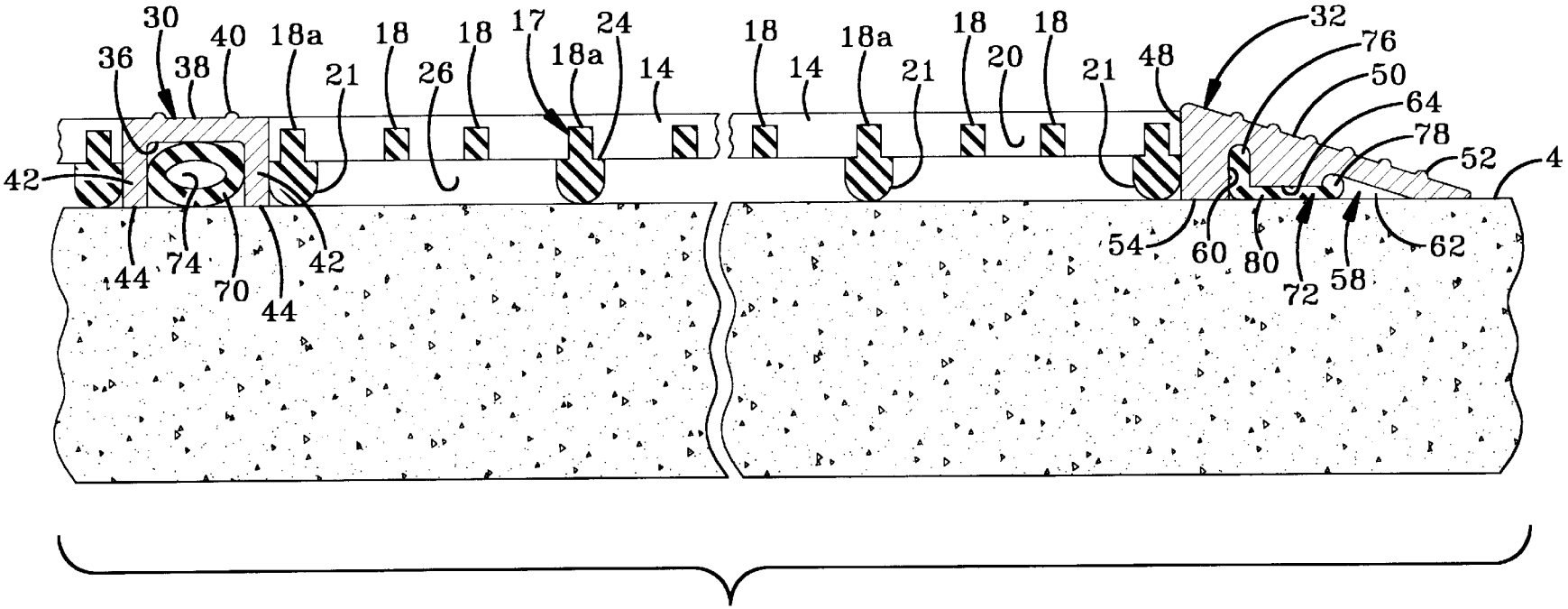
FIG. 4 is a fragmentary sectional view taken along line 4—4, FIG. 3.

When assembled, outer frame members 32 are attached to floor 4 defining a periphery of an area which floor mat system 1 is to cover. Outer frame members 32 have one of floor mats 8 adjacent to and abutting inner sidewall 48 thereof. Inner frame members 30 divide the area to be covered by floor mat system 1 into four by four foot wells 90 (FIG. 3). Inner frame members 30 have a floor mat 8 adjacent to and abutting each sidewall 42 thereof. Each well 90 receives one of floor mats 8 and prevents floor mats 8 from sliding or otherwise moving when walked upon by a customer. Outer frame members 32 and inner frame members 30 offer an additional benefit in that they are of consistent cross section and therefore are extrudable thereby substantially reducing manufacturing costs for floor mat system 1.

In the preferred embodiment, inner frame members 30 have a height of approximately 7⁄16 inches measured from top surface 38 to bottom ends 44 with projections 40 extending approximately 1⁄16 inches above top surface 38. Inner frame members 30 have a width of approximately ¾ inches with bottom ends 44 being ⅛ inches wide and seal receiving recess 36 being ½ inch wide. Similarly, outer frame members 32 have a height of approximately ½ inches measured from the top to the bottom of inner side wall 48. Outer frame members 32 have a width of approximately 1½ inches measured from inner side wall 48 to the outer tip or edge of frame member 32. Thus, outer frame members 32 have a height substantially equal to the height of inner frame members 30 measured from the top of projections 40 to bottom ends 44, or approximately ½ inches. Floor mats 8 are supported by support ribs 18*a* at a height of approximately 7⁄16 inches to allow floor mats 8 to sit relatively even with the top surface of inner frame members 30 creating a substantially flat floor mat system 1 with a sculptured top surface for scraping water and debris from customer's shoes. Projections 40 of inner frame members 30 and the top of outer frame members 32 are slightly higher than floor mats 8 to create additional scraping edges to scrape water and debris from customer's shoes. Top surface 50 of outer frame members 32 are ramped to prevent customers from tripping when stepping from floor 4 onto floor mat system 1.

As the water and debris is scraped from the customer's shoes, it flows through openings 20 into drainage area 26 under floor mats 8. In a large area covered by a plurality of four by four foot floor mats 8, the front most floor mats will tend to accumulate a majority of the water and debris from the customer's shoes, eventually creating an overflow condition. By selectively inserting optional seals 70 and 72 within inner and outer frame members 30 and 32, respectively, the water and debris can be evenly distributed beneath floor mat system 1. For example, in the floor mat system of FIG. 1 where floor mats 8*a* are the front most floor mats which tend to collect a majority of the water and debris, and floor mats 8*b* are the back most floor mats which remain relatively dry, seal 70 may be removed or excluded from inner frame members 30 extending between floor mats 8*a* and 8*b* allowing the water and debris to flow in the direction of arrows A creating an even distribution of the water and debris under floor mat system 1. Floor mats 8*a* and 8*b* will eventually have to be removed from wells 90 allowing the water and debris to be cleaned from wells 90. Floor mats 8*a* and 8*b* are placed back within wells 90 for subsequent reuse.

Also, because floor 4 will not be perfectly flat and support ribs 18*a* will not lay perfectly flat on floor 4, there will be some leakage between drainage areas 26 which are formed between support ribs 18*a*. This leakage between drainage areas 26 allows a floor drain 96 (FIG. 3) to be formed under one of floor mats 8. Drain 96 provides for removal and drainage of water and debris from beneath floor mats 8. Seal 70 may be optionally inserted within any of inner frame members 30 to selectively create a desired flow of water to the area of drain 96. Further, seal 72 may be left out of a portion of one of outer frame members 32 in the event a drain is located outside or adjacent to floor mat system 1. The water or debris may be directed toward one side or end of floor mat system 1 creating a flow to an outer drain 96. Alternatively, floor mats 8 may be removed from wells 90 allowing the debris to be hosed from wells 90 with a water hose with the directional flow allowing the clean water to exit frame assembly 10 as described above.

Figure 5:
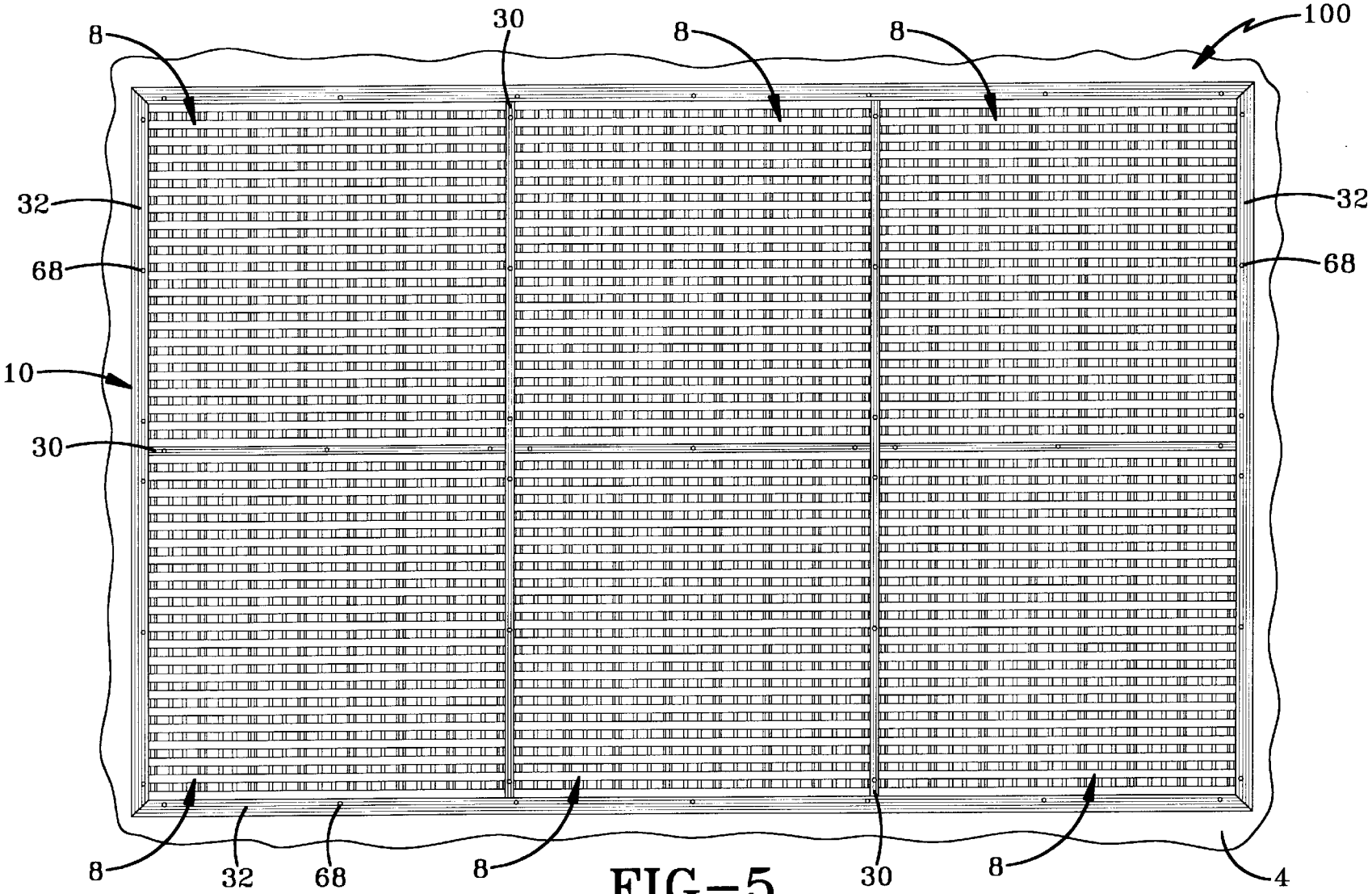
FIG. 5 is a top plan view of a second embodiment of the floor mat system of the present invention.

A second embodiment of the floor mat system of the present invention is indicated at 100 in FIG. 5 and shows six four by four foot floor mats contained within outer frame members 32 and is separated from one another by inner frame members 30. Floor mat system 100 shows that the floor mat system of the present invention may be used to cover any sized area with outer frame members 32 defining the periphery thereof. Any number of inner frame members 30 necessary to divide the area to be covered into four by four foot wells 90 may be included within outer frame members 32. Seals 70 and 72 may be optionally included within seal receiving recesses 36 and 58 of inner and outer frame members 30 and 32, respectively, to direct and disperse the flow of water and debris within drainage areas 26 beneath floor mats 8.

It is understood that floor mat system 1 may be placed within a recessed area formed in floor 4. In such an embodiment, the periphery of floor mat system 1 may be defined by the edges of the recessed area or alternatively, inner frame members 30 may be inserted within the recessed area around the edge thereof to define the periphery of the area to be covered by floor mats 8. Inner frame members 30 will thus have a floor mat 8 adjacent and abutting only one side thereof.

Also, inner frame members 30 may be cut in any manner which allows the inner frame members to form the four by four foot wells 90. For example, FIG. 5 shows one piece inner frame members 30 extending transversely between the longer outer frame members 32 and are of a length substantially equal to the eight foot length of two of floor mats 8 plus the width of the inner frame member extending between the two floor mats 8. For example, inner frame members 32 which extend longitudinally between the floor mats are cut into four foot sections and extend between the shorter outer frame members 32 and the one piece inner frame members 30, and between the one piece inner frame members. Further, it is understood that in the preferred embodiment, floor mats 8 and wells 90 are four foot by four foot but may be other square or rectangular shapes such as three by three foot or three by five foot without affecting the concept of providing a frame assembly having selectively insertable seals to direct and evenly disperse the flow of water beneath the mats.

Accordingly, floor mat systems 1 and 100 include a plurality of floor mats 8 and a frame assembly 10. Frame assembly 10 include inner and outer frame members 30 and 32, respectively, which are formed with seal receiving recesses 36 and 58, respectively. Outer frame members 32 define a periphery of an area to be covered by floor mat system 1 and inner frame members 30 divide the area into four by four foot wells 90. Floor mats 8 are four by four foot in size and are received within wells 90 to prevent any sliding movement thereof. A drainage area 26 is formed beneath floor mats 8 to allow water and debris to flow through openings 20 formed by ribs 14 and 17 of floor mat 8. Seals 70 and 72 may be optionally and selectively inserted within seal receiving recesses 36 and 58, respectively, to direct and disperse the water and debris which accumulates within drainage area 26. Drain 96 may be formed beneath floor mats 8 or adjacent floor mat systems 1 or 100 allowing seals 70 and 72 to be selectively inserted within inner and outer frame members 30 and 32, respectively, to direct the flow of water and debris towards the drain.

Accordingly, the improved floor mat system is simplified, provides an effective, safe, inexpensive, and efficient device which achieves all the enumerated objectives, provides for eliminating difficulties encountered with prior art devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved floor mat system is constructed and used, the characteristics of the construction, and the advantageous, new and useful results obtained; the new and useful structures, devices, elements, arrangements, parts and combinations, are set forth in the appended claims.

I claim:

1. A floor mat system adapted to lay on a floor, said system including:

a mat adapted to lay on the floor;

a frame assembly adapted to lay on the floor and positioned adjacent to the mat, the frame assembly having an outer frame member and at least one inner frame member;

a seal receiving recess formed in the frame assembly;

the seal receiving recess being formed in a bottom of at least one of the outer frame member and the inner frame member;

the inner frame member being generally U-shaped and partially extending around the seal receiving recess; and a seal positioned within the seal receiving recess for preventing the flow of water under the frame assembly.

2. The system defined in claim 1 in which the seal receiving recess is generally U-shaped.

3. The system defined in claim 2 in which the seal receiving recess is formed along the entire length of one of the inner frame members and outer frame members.

4. The system defined in claim 3 in which the seal receiving recess further includes a front section spaced from and parallel to the U-shaped section and a middle section extending between and connecting the front section and the U-shaped section.

5. A floor mat system adapted to lie on a floor, said system including:

a mat adapted to lie on the floor;

a frame assembly adapted to lie on the floor and positioned adjacent to the mat, the frame assembly having an outer frame member and at least one inner frame member;

a seal receiving recess formed in the frame assembly;

the seal receiving recess being formed in a bottom of at least one of the outer frame member and the inner frame member;

the seal receiving recess being generally U-shaped;

the seal receiving recess being formed along the entire length of one of the inner frame members and outer frame members;

the seal receiving recess further including a front section spaced from and parallel to the U-shaped section and a middle section extending between and connecting the front section and the U-shaped section; and the seal being a generally flat member having first and second sides and a middle portion extending therebetween; in which said first side is positioned within the U-shaped section of the seal receiving recess; in which said second side is positioned within the front section of the seal receiving recess; and in which said middle portion is positioned within the middle section of the seal receiving recess.

6. A floor may system adapted to lie on a floor, said system including;

a mat adapted to lie on the floor;

a frame assembly adapted to lie on the floor, said frame assembly surrounding at least the perimeter of said mat whereby the mat is moveably positioned within the frame assembly;

said frame assembly having a seal receiving recess formed in the bottom surface of said frame assembly, said seal receiving recess surrounding the perimeter of said mat; and a seal positioned within said seal receiving recess, said seal forming a seal between said frame assembly and floor to prevent the flow of water under the frame assembly.

7. The system defined in claim 6 in which the frame assembly further includes at least one inner frame member, said inner frame member having a seal receiving recess formed in its lower surface; and a seal disposed within said seal receiving recess of said inner frame member.

8. A floor mat system adapted to lie on a floor, said system comprising:

a frame assembly adapted to lie on the floor;

said frame assembly including an outer frame member that forms the perimeter of the system and at least one inner frame member, said inner frame member cooperating with said outer frame member to form at least two wells;

said inner frame member providing selective fluid communication between said wells under said inner frame member such that liquid in one of said wells may selectively flow under said inner frame member into said other well; and a mat adapted to lie on the floor and removably disposed in each of said wells, each of said mats having a plurality of openings that permit liquid to pass through said mat into said well whereby the mat is moveably positioned within the frame assembly.

9. The system defined in claim 8 in which each of said wells is substantially 4 feet by 4 feet in size.

10. The system defined in claim 8 in which each of said mats abuts said outer frame member and said inner frame member such that said mat is snugly received in said well to prevent said mat from substantially moving within said well.

11. A floor mat system adapted to lie on a floor and adapted to be used in cooperation with a seal between the floor and at least a portion of said floor mat system, said system including:

a mat adapted to lie on the floor;

a plurality of end pieces and side pieces joined to form a frame assembly adapted to lay on the floor and surround at least the perimeter of the mat to form at least one well that receives the mat whereby the mat is moveably positioned within the frame assembly;

said frame assembly including at least one outer frame member and at least one inner frame member;

said outer frame members having an angled top surface, said top surface being angled downwardly from the mat towards the floor; and a seal receiving recess formed in the frame assembly which is adapted to receive the seal therein that forms a liquid-tight barrier between the frame assembly and the floor to seal the well and prevent liquid from leaking out of the well under said frame assembly.

* * * * *